United States Patent [19]

Rentmeester et al.

[11] Patent Number: 5,027,608

[45] Date of Patent: Jul. 2, 1991

[54] METHOD AND APPARATUS FOR DETERMINING FULL LOAD CONDITION IN A SCREW COMPRESSOR

[75] Inventors: Paul C. Rentmeester, La Crosse; Michael W. Murry, Onalaska; Robert E. Krocker, Stoddard; Thomas J. Clanin, Onalaska, all of Wis.

[73] Assignee: American Standard Inc., New York, N.Y.

[21] Appl. No.: 513,326

[22] Filed: Apr. 20, 1990

[51] Int. Cl.[5] ..... F25D 17/02; F25B 1/10

[52] U.S. Cl. ..... 62/115; 82/196.2; 82/201; 82/228.5; 82/230; 417/45

[58] Field of Search ..... 62/228.1, 228.3, 228.5, 62/115, 157, 158, 126, 129, 131, 196.1, 196.3, 201, 215, 217, 209, 226, 227, 229, 230, 231, 510, 175.196.2; 417/45, 280, 282, 292, 32, 26, 279

[56] References Cited

U.S. PATENT DOCUMENTS

| | | | |
|---|---|---|---|
| 4,080,110 | 3/1978 | Szymaszek | 417/280 |
| 4,336,001 | 6/1982 | Andrew et al. | 417/63 |
| 4,519,748 | 5/1985 | Murphy et al. | 417/45 |
| 4,548,549 | 10/1985 | Murphy et al. | 417/53 |

*Primary Examiner*—Harry B. Tanner

*Attorney, Agent, or Firm*—William J. Beres; William O'Driscoll

[57] ABSTRACT

The determination as to whether an operational compressor in a multiple-screw compressor water chiller is fully loaded is made by sending a relatively long duration test pulse to the load solenoid of the compressor. If the compressor is fully loaded, no measurable change in the current drawn by the compressor motor will be measured since no slide valve movement will have occurred and no additional load will have been placed on the compressor. If, however, the compressor is not fully loaded at the time the test pulse is sent, the compressor slide valve will move to load the compressor to an extent such that a reliably measurable change in compressor motor current draw occurs.

20 Claims, 4 Drawing Sheets

LWT = LEAVING WATER TEMPERATURE

X = TEMPERATURE AT WHICH CONSIDERATION BEGINS TO BE GIVEN TO SUBTRACTING A STAGE

A = LOWER DEADBAND TEMPERATURE

B = UPPER DEADBAND TEMPERATURE

S = LEAVING WATER SETPOINT TEMPERATURE

Y = TEMPERATURE AT WHICH CONSIDERATION BEGINS TO BE GIVEN TO ADDING A STAGE

Z = LEVEL AT WHICH IT IS MANDATORY TO ADD A STAGE ($Z_1 + Z_2$)

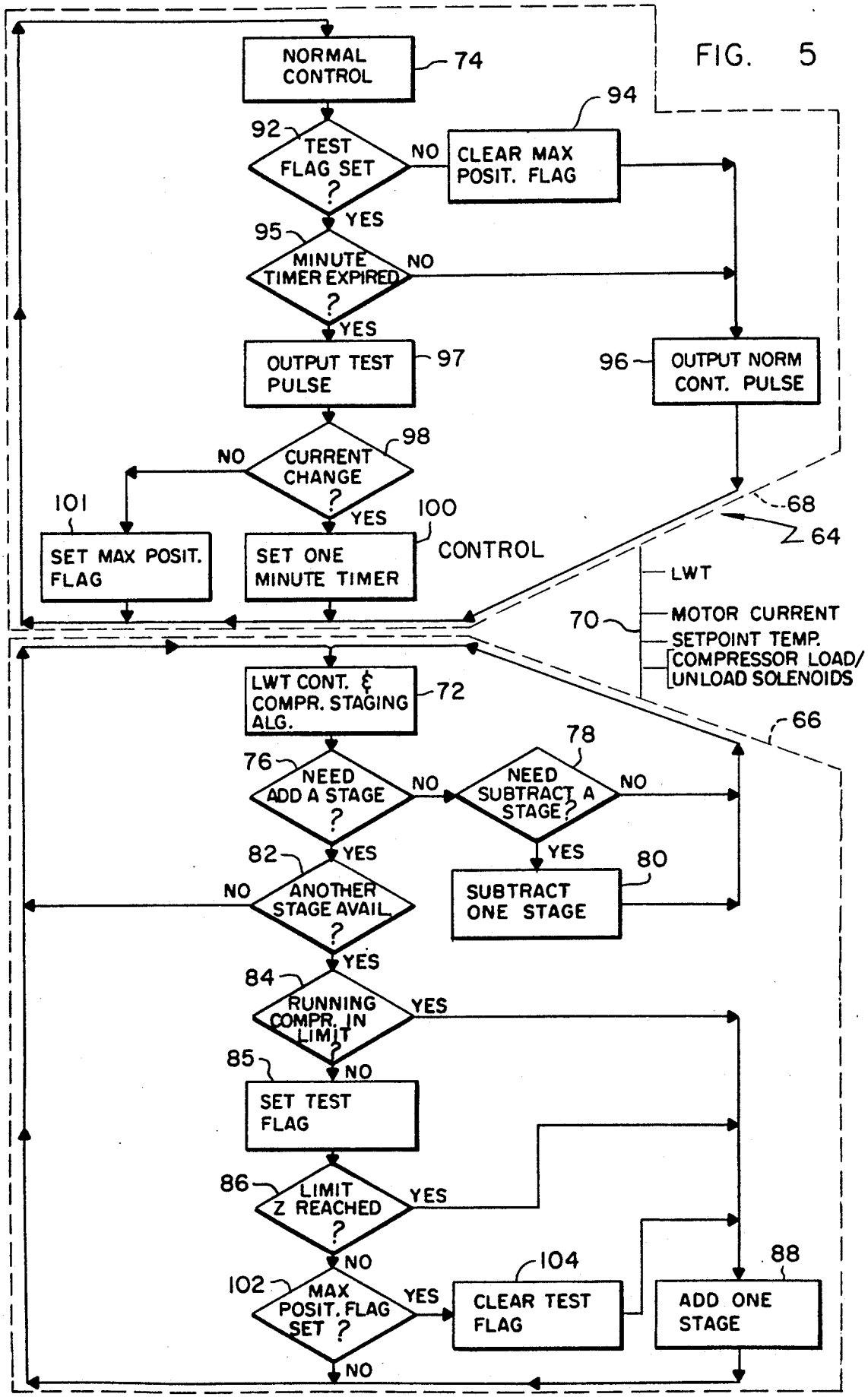
FIG. 5
NORMAL CONTROL
74
92
TEST FLAG SET ?
NO
CLEAR MAX POSIT. FLAG
94
YES
95
MINUTE TIMER EXPIRED ?
NO
YES
OUTPUT TEST PULSE
97
96
OUTPUT NORM CONT. PULSE
98
CURRENT CHANGE ?
NO
YES
101
SET MAX POSIT. FLAG
100
SET ONE MINUTE TIMER
CONTROL
68
64
LWT
70
MOTOR CURRENT
SETPOINT TEMP.
COMPRESSOR LOAD/ UNLOAD SOLENOIDS
LWT CONT. & COMPR. STAGING ALG.
72
66
76
NEED ADD A STAGE ?
NO
78
NEED SUBTRACT A STAGE ?
NO
YES
YES
82
ANOTHER STAGE AVAIL ?
NO
SUBTRACT ONE STAGE
80
YES
84
RUNNING COMPR. IN LIMIT ?
YES
85
NO
SET TEST FLAG
86
LIMIT Z REACHED ?
YES
NO
102
MAX POSIT. FLAG SET ?
YES
104
CLEAR TEST FLAG
88
ADD ONE STAGE
NO

METHOD AND APPARATUS FOR DETERMINING FULL LOAD CONDITION IN A SCREW COMPRESSOR

BACKGROUND OF THE INVENTION

The present invention relates generally to the art of compressing a gas in a rotary screw compressor. More specifically, the present invention relates to a method of determining whether or not a slide valve of a screw compressor, in a water chiller system, is in abutment with the compressor slide stop and therefore, whether the compressor is operating in a fully loaded condition.

Compressors are employed in refrigeration systems, known as chillers, to raise the pressure of a refrigerant gas from a suction pressure to a higher discharge pressure which permits the ultimate use of the refrigerant to accomplish the cooling of the desired medium. Screw compressors employ complimentary male and female screw rotors disposed within the working chamber of a rotor housing to compress gas. The screw rotor housing defines suction discharge ports which are in flow communication with the working chamber of the rotor housing Refrigerant gas at suction pressure enters the compressor working chamber via a suction port at the low pressure end of the rotor housing and is there enveloped in a pocket formed between the rotating complimentary screw rotors The volume of this chevron-shaped pocket decreases and the pocket is displaced toward the high pressure end of the compressor as the rotors rotate and mesh within the working chamber. The gas within such a pocket is compressed and heated by virtue of the decreasing volume in which it is contained, prior to the pocket's opening to the discharge port at the high pressure end of the compressor. The gas pocket, as it continues to decrease in volume, eventually opens to the compressor discharge port at which time the compressed gas is discharged from the working chamber of the compressor.

One advantage of screw compressors resides in the ability to easily modulate their capacity and therefore the capacity of the system in which the compressor is employed. Such capacity control is normally accomplished through the use of a slide valve assembly. The valve portion of the slide valve assembly is built into and forms an integral part of the rotor housing of the compressor and the valve portion of the assembly generally cooperates with the remainder of the compressor's rotor housing to define the working chamber within the compressor. The slide valve is axially movable to expose the screw rotors disposed in the working chamber of the compressor to a location within the compressor, other than the suction port, which is at suction pressure.

The portion of the working chamber initially opened to suction pressure by the movement of the slide valve is that portion immediately downstream of the point at which the compression of refrigerant gas would normally begin within the working chamber. As the slide valve is opened further, a greater portion of the working chamber and the screw rotors therein are exposed to suction pressure. Capacity reduction is therefore obtained by effectively reducing the portion of each rotor used for compression.

When the slide valve is closed, i.e. when it abuts an internal slide stop so as to isolate the rotors from suction pressure other than through the suction port, the compressor is fully loaded and operates at full capacity to compress refrigerant gas. When the slide valve is fully open, that is when the portion of screw rotors exposed to suction pressure other than through the suction port is greatest, the compressor is unloaded to the maximum extent possible.

The positioning of the slide valve between the extremes of the full load and full unload positions is accomplished without difficulty with the result that the capacity of a screw compressor, and the system in which it is employed, is modulated smoothly and efficiently over a large operating range. The slide valve is most often and preferably hydraulically operated by the porting of oil to a piston/cylinder arrangement which is part of the slide valve assembly.

Heretofore, the positioning of the slide valve of some screw compressors employed in water chillers has been a function of the chiller leaving water temperature. That is, irrespective of the actual position of the slide valve in the compressor, its position is modulated to more fully load or unload the compressor in accordance with the difference between actual chiller leaving water temperature and a setpoint temperature so as to produce the amount of refrigeration necessary to produce water at the setpoint temperature. This control scheme is particularly appropriate for water chillers employing a single screw compressor where, once the compressor is fully loaded, no additional refrigeration capacity is available.

However, certain newer water chillers employ more than one screw compressor which requires that a determination be made as to when to energize or de-energize a second compressor in accordance with the need for more or less refrigeration capacity as the case may be. If an operating compressor, in a multiple compressor system, is not fully loaded and therefore has further refrigeration capacity, the slide valve of that compressor can be moved to more fully load that compressor as opposed to energizing another compressor which would be wasteful of energy. However, if the first compressor is operating fully loaded, i.e. the slide valve of that compressor is in abutment with the slide stop, the energization of a second compressor will be required to gain more refrigeration capacity.

In previous screw compressor chillers particularly single compressor water-cooled chillers, the actual movement of the compressor slide valve was readily and reliably indicated by the measurable increase or decrease in compressor motor current draw which coincided with the increase or decrease in load on the compressor which resulted from slide valve movement. However, in the newer chiller systems referred to in the immediately preceding paragraph which can be multiple screw compressor air-cooled water chillers, the change in measured compressor motor current draw, even after several incremental changes in slide valve position, is not necessarily a reliable indicator of the actual movement of the slide valve. This is because chiller system voltage changes, the energization or de-energization of fans, the movement of components such as electronic expansion valves changes in water temperatures and the like can alone or in combination all affect the current drawn by the motor of an operating compressor.

Therefore, in order to use motor current draw as a reliable indicator of slide valve position, and more particularly, as an indicator that the slide valve of a compressor is in abutment with the slide stop which further indicates that the compressor is operating at full load, a discrete method to positively identify such condition by employing compressor motor current draw is required.

SUMMARY OF THE INVENTION

It is a principal object of the present invention to provide a method for determining whether an operating screw compressor in a water chiller employing multiple screw compressors is operating in a fully loaded condition.

It is another object of the present invention to determine whether an operating screw compressor in a water chiller employing multiple screw compressors is operating in a fully loaded condition absent direct mechanical or electro-mechanical indication of actual slide valve position within the compressor.

It is still another object of the present invention to provide a method for determining whether an operating screw compressor in a water chiller employing multiple screw compressors is operating in a fully loaded condition by sensing or failing to sense an increase in compressor motor current draw where other system parameters such as voltage, the status of condenser fan operation, electronic expansion valve movement and the like can affect compressor motor current draw.

It is yet another object of the present invention to provide a method for determining whether a screw compressor in an air-cooled water chiller system employing multiple screw compressors is operating fully loaded by monitoring the current drawn by the motor of an operating compressor in a manner such that (1) a measured change in compressor motor current draw is a reliable indicator of actual slide valve movement while (2) the failure of the compressor motor current draw to change is a reliable indicator of the close proximity or abutment of the slide valve against the compressor slide stop and the inability of the slide valve to move to further load the compressor.

It is a still further object of the present invention to provide a method for determining whether a first screw compressor in a multiple compressor water chiller is fully loaded so that under relatively slowly changing leaving water temperature conditions an expeditious and anticipatory determination can be made to energize an additional compressor in order to minimize leaving water temperature excursions from the chiller's leaving water setpoint temperature.

These and other objects of the present invention, which will be apparent when the attached drawing figures and following description of the preferred embodiment are considered, are accomplished by control apparatus for a multiple-screw compressor water chiller. The apparatus electronically tests for the abutment of the slide valve against the slide stop in an operating compressor by providing a test signal of sufficient duration which, if the slide valve is not against the slide stop and irrespective of the effects of other system operating parameters, will cause actual slide valve movement and compressor loading to a degree which is readily and reliably detectable as an increase in the current drawn by the compressor motor. Conversely, the failure to sense an increase in motor current draw, which is indicative of actual increased compressor loading, subsequent to the sending of the test control pulse indicates that the slide valve of the compressor is in close proximity or abutment with the slide stop and that the compressor is operating in an essentially fully loaded condition.

BRIEF DESCRIPTION OF THE DRAWINGS

FIG. 5 is a flow diagram setting forth the control method for the water chiller of the present invention.

DESCRIPTION OF THE PREFERRED EMBODIMENT

Figure 3:
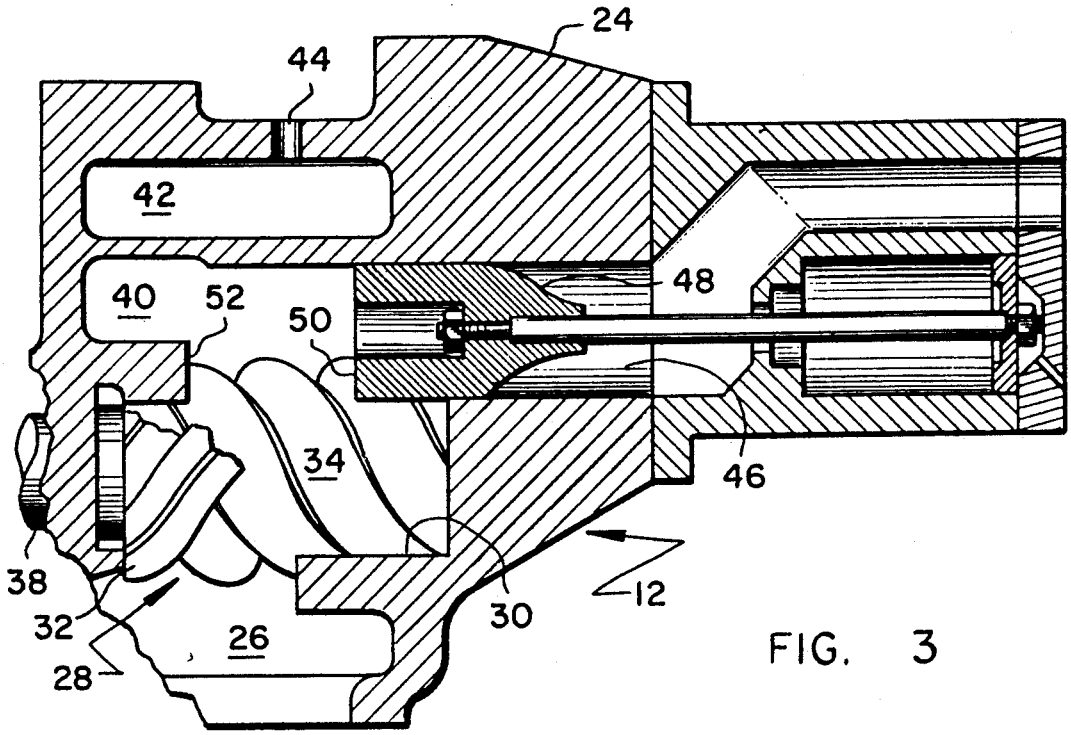
FIG. 3 is a partial view of the compressor of FIG. 2 illustrating the compressor in its fully unloaded state.
Figure 1:
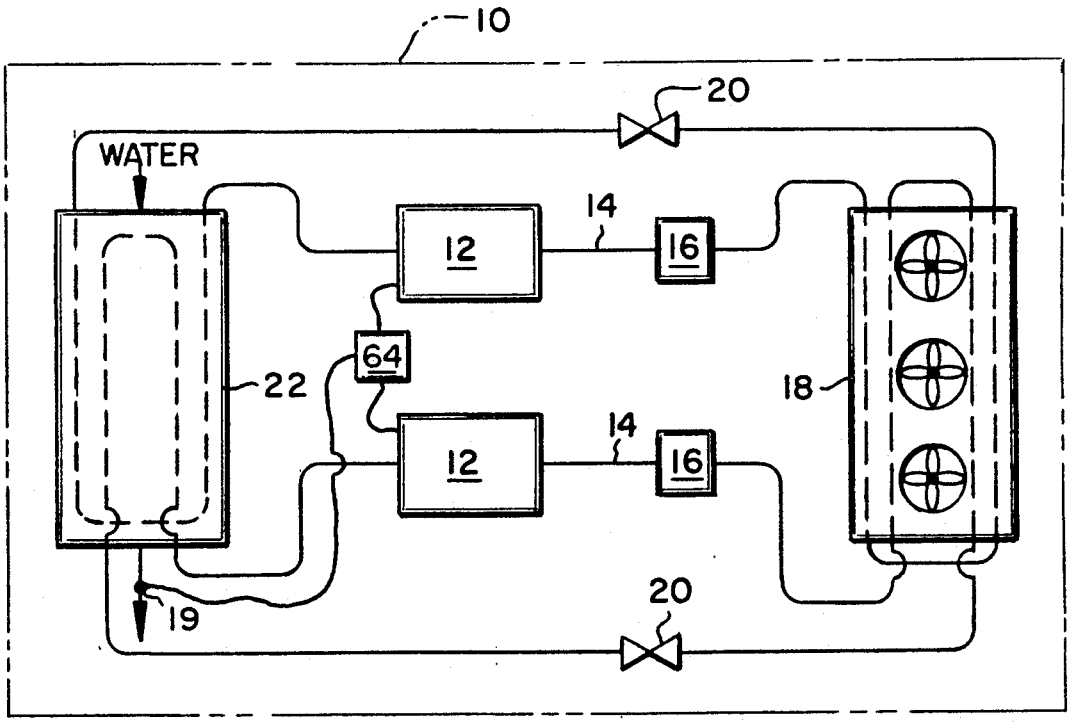
FIG. 1 schematically illustrates the water chiller of the present invention which employs multiple screw compressors.
Figure 2:
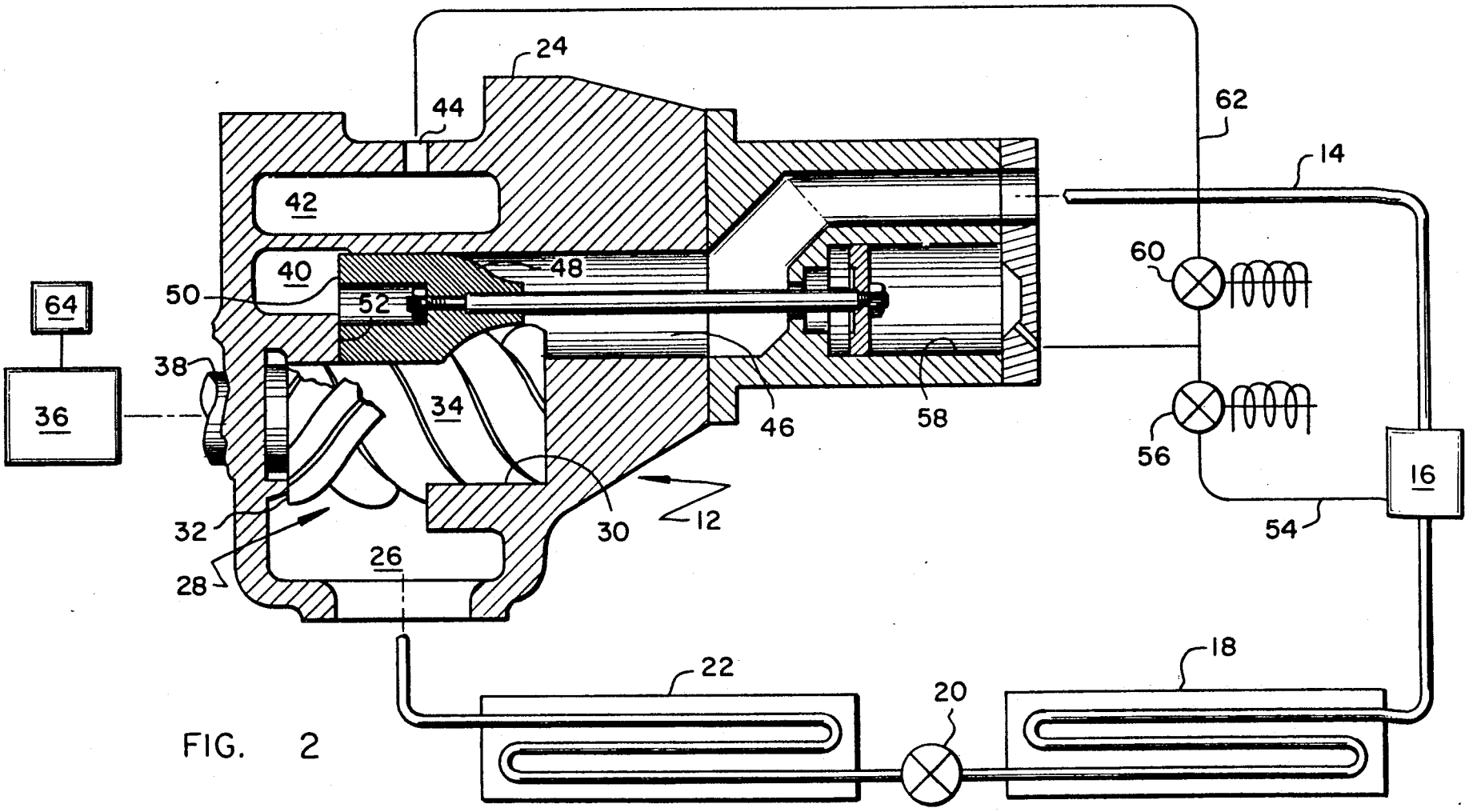
FIG. 2 is a cross-sectional view of one of the screw compressors of the refrigeration system schematically illustrated in FIG. 1 where the compressor slide valve is in abutment with its slide stop indicating the full loading of the compressor.

Referring initially to FIGS. 1, 2 and 3, a water chiller 10 includes multiple screw compressor assemblies 12 from which compressed refrigerant gas, in which oil is entrained, is directed through discharge conduits 14 to oil separators 16. Although the present invention will be described in terms of a two-compressor chiller it should be appreciated that the present invention is applicable to chillers employing more than two compressors.

Refrigeration system 10 further includes a condenser 18, expansion devices 20 and an evaporator 22. Condenser 18 and evaporator 22 are piped or plumbed such that separate refrigeration circuits are maintained therein for each compressor in the chiller.

Compressed refrigerant gas, from which oil has been separated, is directed from oil separators 16 to condenser 18 where it is condensed and becomes a relatively low temperature high pressure liquid. From condenser 18, the refrigerant in the discrete refrigeration circuits is directed to expansion devices 20, which may be electronic or thermal expansion valves, where it becomes a relatively low temperature, low pressure liquid by the process of expansion. The low pressure, low temperature liquid refrigerant next enters evaporator 22 and is there vaporized in a heat exchange relationship with water flowing therethrough. Low pressure, low temperature refrigerant gas is therefore returned from evaporator 22 to compressors 12 after chilling the water flowing through the evaporator.

Referring primarily now to FIG. 2, which is illustrative of an individual one of the compressors of chiller 10 and its dedicated refrigerant circuit, with the understanding that this description, unless otherwise indicated, applies to each compressor and its dedicated refrigerant circuit within the chiller, compressor 12 includes a rotor housing 24 which defines a suction volume 26 into which vaporized low pressure refrigerant gas is communicated from evaporator 22 when the compressor is in operation. Rotor housing 24 also defines a suction port 28 through which suction gas received from evaporator 22 is admitted to compressor working chamber 30.

Attached to the driven one of screw rotors 32 and 34, which are disposed in working chamber 30, is compressor drive motor 36 which drives shaft 38 on which the driven screw rotor is mounted. Suction volume 26, in the preferred embodiment, defines suction sub-areas 40 and 42 all of which are in flow communication within rotor housing 24. Rotor housing 24 also defines an opening 44 into suction sub-area 42, the purpose of which will later be described.

Rotor housing 24 also defines a discharge port 46 through which compressed refrigerant gas is discharged from working chamber 30. Disposed within rotor housing 24 and cooperating therewith to define working chamber 30 is a slide valve 48 which is axially movable with respect to rotors 32 and 34 within rotor housing 24.

In the position illustrated in FIG. 2, working chamber 30 is isolated from suction sub-area 40 due to the abutment of end face 50 of slide valve 48 abuts slide stop 52 In the position illustrated in FIG. 3, in which the degree to which rotors 32 and 34 are exposed to suction sub-area 40 is at a maximum, end face 50 of valve 48 is at its point of farthest physical removal from slide stop 52 and the degree to which rotors 32 and 34 are exposed to suction sub-area 40 is at a maximum.

When end face 50 of slide valve 48 abuts slide stop 52 of rotor housing 24, as illustrated in FIG. 2, direct flow communication between working chamber 30 and suction subarea 40 is prevented and the only supply of suction gas to the working chamber is through suction port 28. When slide valve 48 abuts slide stop 52 compressor 12 operates at full load. When slide valve 48 is in the position illustrated in FIG. 3, in which rotors 32 and 34 are exposed to suction sub-area 40 to the maximum extent, the exposed rotor areas are rendered incapable of compressing refrigerant gas and the compressor is operating at its lowest capacity. When slide valve 48 is at an intermediate position between the positions illustrated in FIGS. 2 and 3, the compressor is operating at a part load condition which is determined by the position of the slide valve and degree of exposure of the rotors to suction sub-area 40.

The compressed gas discharged from compressor 12 flows through discharge port 46 and discharge conduit 14 to oil separator 16. It will therefore be appreciated that when compressor 12 operates, oil separator 16 is at discharge pressure as will be the oil separated from the discharge gas therein. Such oil, which, once again, is at discharge pressure when the compressor with which it is used in is in operation, is selectively directed out of oil separator 16 through conduit 54 to a load solenoid valve 56 as will further be described.

When load solenoid valve 56 is pulsed open for a predetermined relatively short period of time, oil at discharge pressure is ported into chamber 58 of compressor 12 so as to cause the incremental movement, over a relatively small predetermined distance, of slide valve 48 toward slide stop 52 within rotor housing 24. Therefore, as oil is ported through solenoid 56 into chamber 58 slide valve 48 is moved to load the compressor.

When it is desired to unload the compressor, chamber 58 is vented through an unload solenoid valve 60. When solenoid valve 60 is pulsed open the oil in chamber 58, which is at discharge pressure, vents through unload solenoid valve 60 and conduit 62 to suction sub-area 42 through opening 44 in the rotor housing. As a result, the slide valve will incrementally move away from slide stop 52 to slightly further unload the compressor in response to each normal control pulse As was earlier mentioned, it should be understood chiller 10 employs multiple screw compressors 12 each of which in the preferred embodiment, is a component of a discrete refrigeration circuit. While the refrigeration circuits within chiller 10 are discrete circuits, they employ a common evaporator 18 and condenser 22. The fact that the refrigeration circuits in the preferred embodiment are independent circuits should in no way be construed as limiting the breadth of the invention claimed herein. That is, the current invention could readily be adapted for use in a manifolded compressor system in which multiple compressors are employed in conjunction with a single refrigeration circuit.

It should also be understood, before proceeding, that under normal operating conditions load and unload solenoids 56 and 60 are pulsed open and closed for relatively short "normal" predetermined periods of times, as will further be described, so as to achieve a relatively fine incremental control of slide valve position and therefore, precise control of the load on the compressor. Because the incremental movement of the slide valve in response to a "normal" control pulse is relatively small, the change in the amount of current drawn by the compressor in response to such incrementally controlled slide valve movement and compressor loading and unloading, even over a period of time during which several control pulses are sent, is difficult to reliably measure. This is particularly true in chillers of the air-cooled type where the movement, energization and de-energization of other system components can affect the amount of current drawn by the compressor motor to a degree similar to that of the incremental movement of the slide valve.

It will therefore be appreciated that the abutment of slide valve 48 with slide stop 52 may not necessarily result in a reliably measurable or appreciable change in compressor motor current draw. Therefore, if a change in motor current draw or a lack thereof is to be used as an indicator of the full loading of a compressor, a reliable method for doing so, in view of the effect of other system parameters on compressor motor current draw, is required.

Figure 4:
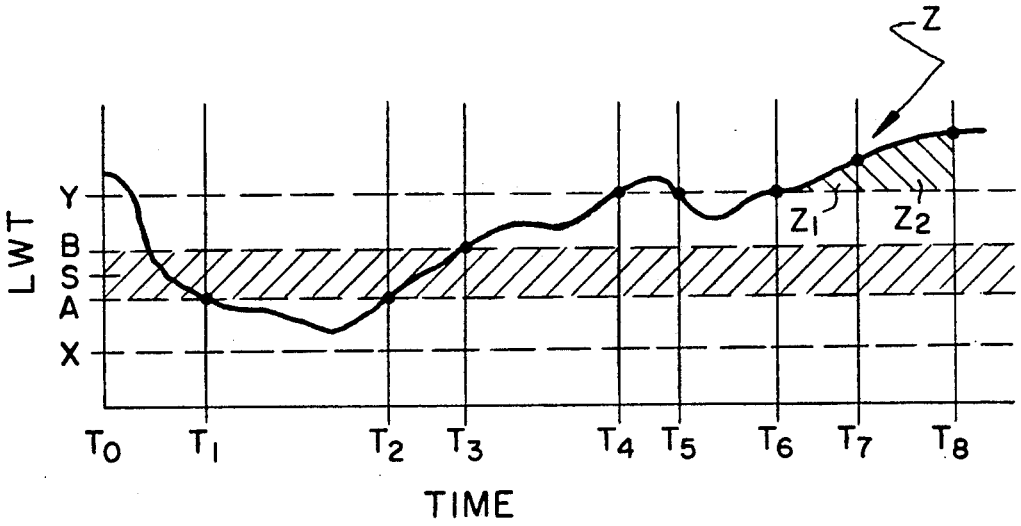
FIG. 4 is a graph indicative of chiller system operation over time versus leaving water temperature.

Referring additionally now to FIG. 4, a graph illustrates an example of what the chiller evaporator leaving water temperature (LWT) might be during various periods of the operation of chiller 10. The leaving water temperature is the temperature of the chilled water as it flows out of evaporator 22 after having undergone a heat exchange relationship with refrigerant flowing through one or more of the refrigeration circuits therein and is sensed by temperature sensor 19 as is indicated in FIG. 1. Chiller 10 is preferably controlled so as to achieve a selectable leaving water setpoint temperature for the reason that the chilled water leaving evaporator 22 is used in industrial processes and/or in the comfort conditioning of buildings which requires the supply of chilled water closely temperature controlled to a predetermined temperature.

From FIG. 4 it will be appreciated that, for example, at a time $T_0$ LWT exceeds temperature Y in which case a first or additional compressor 12 of chiller 10 is energized. At time $T_0$ LWT is at a temperature above both an upper dead band limit temperature B and above temperature Y which is a temperature at which the energization of another compressor of chiller 10 might be called for to supply additional refrigeration capacity as will further be discussed.

Because LWT at time $T_0$ is above dead band temperature B and temperature Y as well as being above setpoint temperature S, which is the temperature to which LWT is to be controlled, it will be appreciated that at the very least, an already operating compressor must be further loaded so as to bring the LWT down. Therefore, the load solenoid 56 of such operating compressor will be pulsed open in accordance with a running compressor control algorithm, as will further be discussed, so as to cause slide valve 48 to move toward its slide stop 52 to further load the compressor. When LWT is between deadband limits A and B, the slide valve 48 of the controlled compressor is not moved as LWT is within a predetermined range closely proximate to the desired setpoint temperature S. At time $T_1$, LWT has decreased and is lower than setpoint temperature S to the extent that it has reached the lower deadband limit temperature A.

Once LWT decreases and becomes less than lower deadband limit A, slide valve 48 of the compressor is controlled so as to unload the compressor to bring LWT back up to the desired setpoint temperature S. Once again, in order to unload the compressor unload solenoid 60 is pulsed, in accordance with a control algorithm, so that chamber 58 is vented to suction thereby causing slide valve 48 to move away, in an incremental manner, from slide stop 52 to unload the compressor and raise the LWT. At time $T_2$ LWT has increased back to the lower deadband limit temperature and, once again, from time $T_2$ to time $T_3$, when LWT is within the deadband, slide valve 48 is not moved.

Between time $T_3$ and $T_4$ LWT increases from upper deadband limit temperature B to temperature Y. Since LWT is less than temperature Y, the running compressor will be controlled and more fully loaded in an attempt to move LWT down to the setpoint temperature during this time period. Temperature Y is, once again, a temperature at which consideration is given to energizing another chiller system compressor, if one is available, to increase chiller system refrigeration capacity to deal with an increase in leaving water temperature. It will be apparent, however, that if the already energized compressor is not fully loaded there may be no need to energize an additional compressor, even at time $T_4$, to provide the increased refrigeration capacity needed to lower leaving water temperature.

The chiller controller, as will further be described, will therefore, when LWT exceeds temperature Y, make a determination whether or not to energize another compressor to provide additional cooling capacity based upon (1) the rate of increase of LWT or (2) the length of time LWT has exceeded temperature Y after temperature Y is exceeded. In the example of FIG. 4, LWT is illustrated as just having barely exceeded temperature Y at a slowing rate of change at time $T_4$ and as having decreased back to temperature Y at time $T_5$. In such instances an additional compressor, even if available, will not have been energized by the chiller system controller because the rate of change of LWT was insufficient to call for the addition of another compressor and/or the length of time LWT exceeded temperature Y was sufficiently short.

Between times $T_5$ and $T_6$ it will be appreciated that LWT decreases below but then increases back to temperature Y At time $T_6$ a steady increase of LWT beyond temperature Y is seen to commence with the result that at time $T_7$ LWT has increased sufficiently to warrant consideration being given to energizing another compressor so as to obtain additional cooling capacity and at time $T_8$ the need to energize another compressor becomes mandatory as will further be described.

Now, with all of the above in mind and referring additionally to FIG. 5, it will be appreciated that chiller controller 64 is comprised of individual control components including a leaving water temperature control processor 66, referred to as the CPM, and a running compressor control processor 68, referred to as the MCSP. CPM 66 and MCSP 68 are in communication via communications line 70 through which control and various compressor and system status signals pass to, among and between chiller components and the chiller controller components.

When the load on chiller 10 increases and additional cooling capacity is required, such capacity can be obtained by further loading an already running compressor or by energizing another compressor should the running compressor or compressors be at full load. A determination is therefore required to be made as to whether or not the already operating compressor (or compressors) is fully loaded, prior to energizing an additional compressor since, if an already running compressor is not fully loaded, it can be further loaded to provide additional cooling capacity.

DESCRIPTION OF OPERATION, LWT BETWEEN TEMPERATURES X AND Y OR BELOW TEMPERATURE X: NEED TO ENERGIZE ADDITIONAL COMPRESSOR NOT INDICATED

Referring primarily now to FIGS. 4 and 5, during normal periods of operation in which the LWT is between temperatures X and Y, which indicates that there is no need to energize an additional compressor due to the operating compressor's ability to adequately control LWT, the leaving water temperature control processor CPM 66 runs a leaving water temperature control and compressor staging algorithm as is indicated in block 72 in FIG. 5 while running compressor control processor MCSP 68 concurrently runs a compressor control algorithm, indicated in block 74 of MCSP 68.

So long as LWT is such that the running compressor or compressors are capable of maintaining LWT by modulating the position of the slide valve of a less than fully loaded operating compressor, no consideration is given by the leaving water temperature control processor 66 to energizing an additional compressor or to de-energizing a running compressor, as the case may be. This will be evident from decision steps 76 and 78 which are carried out by leaving water temperature control processor 66 when LWT is less than temperature Y but greater than temperature X. Under these circumstances control block 72 will be returned to from decision step 78 in the leaving water temperature control processor.

Also under the circumstances of LWT being between temperatures X and Y, running compressor control processor 68 initiates the output of "normal", relatively short control pulses and will direct such pulses to load and unload solenoids 56 and 60, as the case may be, of the running compressor or the compressor of more than one running compressor which is not at full load to incrementally modulate the position of its slide valve 48, in accordance with a normal control algorithm and the need to load or unload the compressor to maintain LWT between temperatures X and Y and to achieve the leaving water temperature set point.

Part of normal control algorithm 74 is a series of control steps which are carried out, under conditions which will subsequently be discussed, to determine whether the slide valve 48 of the controlled compressor is in abutment with its slide stop 52 which would indicate that the controlled compressor is running at or near full load. Therefore, during the course of normal control of slide valve 48, running compressor control processor 68 queries, in decision block 92, leaving water temperature control processor 66 to determine whether a test flag has been set indicating the need to determine whether the slide valve of the controlled compressor is proximate to or against its slide stop so as to further determine whether an additional compressor is required to be energized.

In order for the test flag to be set within leaving water temperature control processor 66, leaving water temperature must exceed temperature Y. If LWT is not in excess of temperature Y, as determined in decision block 76, the determination is next made, in decision block 78 of processor 66, as to whether LWT is sufficiently low (below temperature X) to warrant de-energizing a compressor.

If LWT is not below temperature X, normal control block 72 in processor 66 is re-entered as was indicated above, a test flag is not set by processor 66 and compressor control processor 68 continues to output normal compressor control pulses as is indicated in control block 96. If LWT is below temperature X, a compressor is de-energized by processor 66 in accordance with control block 80 and control block 72 is subsequently re-entered.

LWT GREATER THAN TEMPERATURE Y: POSSIBLE NEED TO ENERGIZE AN ADDITIONAL COMPRESSOR RECOGNIZED

If the leaving water temperature LWT exceeds temperature Y, meaning that conditions may warrant energizing an additional compressor, an integration of the time-leaving water temperature curve starting at time $T_6$ and with respect to temperature Y, is initiated in decision block 76 of processor 66 and decision block 82 is proceeded to. In decision block 82, a determination is made as to whether or not there are any de-energized compressors available to be energized in the first instance. If another stage, i.e. compressor, is not available, the normal leaving water temperature control and compressor staging algorithm 72 is re-entered from decision block 82.

If, however, another compressor is available to be energized, decision block 84 is entered in processor 66 which determines whether the running compressor is operating in a limit condition, such as, for example, having reached an operating pressure or temperature limit. If a compressor is running in a limit condition it cannot be further loaded, even if not already fully loaded, without the limit condition being exceeded. If it is determined in decision block 84 that the running compressor is in a limit condition, leaving water temperature control processor 66 will automatically cause another compressor to be energized as is indicated in control block 88, irrespective of whether or not the running compressor is or is not fully loaded.

If it is determined in decision block 84 that a running compressor is not in a limit condition, leaving water temperature control processor 66 proceeds to set a test flag in control block 85 at such time as the integration of the time-leaving water temperature curve with respect to temperature Y, which was initiated in decision block 76, yields a value which exceeds a predetermined value $Z_1$. The value $Z_1$ is reached when the area under the time-leaving water temperature curve exceeds a predetermined value which, in FIG. 4, is illustrated to occur at some time $T_7$, depending upon the value selected for value $Z_1$.

The value $Z_1$ is indicative that leaving water temperature is rising fast enough and/or has exceeded temperature Y long enough to indicate that the energized compressor or compressors may be unable to satisfactorily regain control of the leaving water temperature given the conditions under which the chiller is operating and that another compressor may be required to be energized to bring the leaving water temperature down. It should be noted that even minor variations in leaving water temperature are unacceptable and that temperature Y will typically be on the order of 1.5° F. or so higher than the leaving water setpoint temperature. Once the value $Z_1$ is exceeded, a test flag is set in control block 85 and decision block 86 is proceeded to in processor 66.

Before proceeding to describe controller 64 further, it should be appreciated that there are many available criteria for setting the test flag once temperature Y is exceeded. While integrating the time-temperature curve above temperature Y until value $Z_1$ is exceeded is the preferred means, the test flag might also be set based strictly upon time or temperature criteria standing alone. That is, the test flag could be set at some predetermined time subsequent to the time LWT exceeds temperature Y or at such time as LWT exceeds temperature Y by a predetermined number of degrees.

It should also be remembered that the mere fact that LWT exceeds temperature Y will not alone be cause for the energization of an additional compressor. There may be instances, such as is illustrated between times $T_4$ and $T_5$ in FIG. 4 where LWT exceeds temperature Y for a relatively brief period and/or increases at a rate which is less than that which is needed in order for the test flag to be set. Likewise even if the test flag is set, if LWT decreases sufficiently and/or quickly enough such that it decreases below temperature Y subsequent to the setting of the test flag yet before an additional compressor is energized, there will then be no need to energize an additional compressor. Under these circumstances the test flag will be cleared in control block 72 as part of the normal leaving water control and compressor staging algorithm.

Referring once again to FIGS. 4 and 5, once value $Z_1$ is reached and the test flag has been set, at time $T_7$, control block 86 is proceeded to where a determination is made as to whether a limit Z has been reached. Limit Z is a predetermined value which, when and if reached, by the continued integration of the time-leaving water temperature curve above temperature Y, subsequent to the setting of a test flag at time $T_7$, automatically results in the immediate energization of another compressor as is indicated in control block 88.

It will be appreciated, in referring to FIG. 4, that limit Z is reached at time $T_8$ when the area under the time-leaving water temperature curve between times $T_6$ and $T_8$ reaches the value established for limit Z. That is, when the area $Z_1$, between times $T_6$ and $T_7$, when added to the area $Z_2$, between times $T_7$ and $T_8$, reaches the predetermined value for limit Z. Once again, if the limit Z is reached in decision block 86 by the continued integration of the time-LWT curve, the leaving water temperature control processor 66 proceeds immediately to energize an additional compressor in control block 88. So long as limit Z is not reached, however, leaving water temperature control processor 66 proceeds to decision block 102 and begins to query compressor control processor 68 to determine if a maximum position flag has been set as will subsequently be described.

As earlier mentioned, running compressor control processor 68, as part of its normal control routine of block 74, periodically queries leaving water temperature control processor 66 as to whether the test flag of control block 85 is set. Running compressor control processor 68 does so as part of the control process associated with decision block 92.

If, in response to a query of LWT control processor 66, compressor control processor 68 determines that the test flag of control block 85 has not been set, running compressor control processor 68 clears a maximum position flag, if it has been set, as is indicated in control block 94. As will later be described a maximum position flag will be set by processor 68 in control block 101 subsequent to a determination that the controlled compressor is operating in an essentially fully loaded condition. A "normal" slide valve control pulse is then output by processor 68 as indicated in control block 96 to the load or unload solenoids, as the case may be, of the running compressor to modulate the position of the slide valve 48, in accordance with system demands, to load or unload the compressor.

A "normal" slide valve control pulse, once again, is a relatively short duration electrical signal sent by controller 64 to a compressor load or unload solenoid. The short duration normal control pulses cause small predetermined incremental movements in the compressor slide valve. The result of such small incremental movements may be that only a very slight and not reliably measurable change in the current drawn by the motor of the controlled compressor occurs. As earlier mentioned, even if motor current draw is measured after the sending of several incremental "normal" control pulses over a relatively long period of time, a reliably measurable change in the current drawn by the compressor motor may still not necessarily have occurred.

Therefore, the close proximity or abutment of the slide valve with the slide stop and the essentially full loading of a controlled compressor may not be apparent or manifested by a reliably measurable change in motor current draw, even after the slide valve has been incrementally moved several times and over a relatively lengthy time period to further load the compressor. Thus, if a change in motor current draw is to be employed to determine whether the controlled compressor is fully loaded so as to trigger the energization of another compressor, a clearly manifested and reliably measurable representative change in motor current draw over a relatively short period of time is required to be produced.

If in response to a query of LWT processor 66, compressor control processor 68 determines, in decision block 92, that the test flag of control block 85 in LWT control processor 66 has in fact been set, meaning that value $Z_1$ has been reached, a decision is made in decision block 92 within the running compressor control processor 68 to initiate a test of the controlled compressor, in anticipation of the need for additional refrigeration capacity based upon the trend of the leaving water temperature, to determine whether or not it is running fully loaded, i.e. with its slide valve in close proximity to or abutment with its slide stop. Therefore, decision block 95 is entered from decision block 92 within compressor control processor 68.

If the one minute timer within the compressor control processor has not expired, control block 96 is entered from decision block 95 and compressor control processor 68 continues to send normal, short-duration control pulses, in control block 96, to the load or unload solenoids of the controlled compressor, as the case may be, until such time as the one minute timer expires.

Once the one minute timer expires, however, control block 97 is entered from decision block 95 and running compressor control processor 68 outputs a "test" control pulse to the load solenoid of the controlled compressor. The test pulse sent to the load solenoid of the controlled compressor is of a predetermined relatively long duration, when compared to the duration of a "normal" control pulse, such that if the slide valve of the controlled compressor is not in abutment with or closely proximate to its slide stop, the slide valve will move toward the slide stop to a degree much greater than that which will occur in response to a "normal" or even several consecutive normal load control pulses. As a result, under such circumstances, the compressor will be loaded to an extent which will, in all cases, result in a monitorable immediate increase in the current drawn by the compressor drive motor attributable specifically to the production of a test control pulse.

Contrarily, it will be appreciated that if, when a test pulse is sent, the slide valve is sufficiently close to or already in abutment with the slide stop, meaning that the compressor is operating essentially fully loaded, no significant movement of the slide valve and no readily measurable or apparent change in the current drawn by the compressor motor will occur since no further load of any consequence will have been placed upon the compressor by the production of the test pulse.

Thus, the absence of change in compressor drive motor current, in response to the sending of a test pulse, reliably indicates that the compressor is operating at or near full load. When a test pulse is sent, the controlled compressor's motor is monitored by controller 64 to determine whether or not a motor current change of a predetermined magnitude occurs which is attributable to the sending of the test pulse.

As is indicated in FIG. 5, a decision is made in block 98 such that if a detectable change in compressor motor current draw occurs in response to the sending of a test pulse indicating that the compressor is not fully loaded and is capable of delivering further refrigeration capacity, the one minute timer is set in control block 100 and normal control block 74 is reentered. If, however, no change in compressor motor current draw is detected or if the change in motor current is less than a predetermined magnitude in response to the sending of a test pulse, indicating that the tested compressor is operating essentially fully loaded control block 101 is entered and a maximum position flag is set in running compressor control processor 68.

At such time as the maximum position flag is set in control block 101 within the running compressor control processor 68, a decision is made in block 102 within LWT processor 66, in response to its continued query of the running compressor control processor, to clear the test flag set in control block 85. The clearing of the test flag occurs in control block 104 within LWT processor 66. If, upon reaching decision block 102 the maximum position flag had been determined not to have been set in compressor control processor 68, the normal leaving water temperature control and compressor staging algorithm control block 72 is re-entered from block 102.

Finally, as soon as the test flag is cleared in control step 104 within LWT processor 68, control block 88 is proceeded to and an additional compressor is energized with the assurance that the already energized compressor or compressors are fully loaded and are essentially incapable of producing the required additional refrigeration capacity. The leaving water control algorithm of control block 72 is in all cases re-entered from control block 88.

It will be appreciated that while the present invention has been described in terms of monitoring current drawn by the electric drive motor of a screw compressor, it is likewise applicable to other screw compressor drive means or prime movers, such as internal combustion engines, which will exhibit monitorable changes in certain of their operating parameters in response to changes in the load on the screw compressors which they drive.

While the present invention has been described in the context of a preferred embodiment, it will also be appreciated that there are many modifications and variations which are within the scope of the present invention so that its breadth should in no way be limited other than in accordance with the language of the claims which follow.

What is claimed is:

1. A method of determining whether a refrigeration screw compressor is running in an essentially fully loaded condition comprising the steps of:

controlling the position of the slide valve of said compressor by, at predetermined intervals, producing a normal control pulse, in response to a requirement to load or unload said compressor, a normal control pulse causing said slide valve to move a predetermined incremental distance;

monitoring a parameter associated with the :; operation of the prime mover which drives said compressor, said parameter being a parameter which changes in accordance with producing, under predetermined conditions indicative of the need for said compressor to produce further refrigeration capacity a test control pulse in response to which, if said compressor is not essentially fully loaded, said slide valve moves a distance greater than said incremental distance to further load said compressor, said further load causing a change in said operating parameter which is monitorable and directly attributable to the production of said test pulse and the slide valve movement which results therefrom, irrespective of the influence of other conditions associated with the operation of said compressor that can cause said parameter to change.

2. The method according to claim 1 wherein said prime mover is an electric motor and wherein said parameter is the current drawn by said motor.

3. The method according to claim 2 wherein said controlling step comprises the steps of directing oil at a relatively high pressure to a chamber in which a piston attached to said slide valve is located, so as to move said slide valve in response to a requirement to further load said compressor; and, venting said chamber to an area within said compressor which is at a pressure lower than said relatively high pressure, so as to cause said slide valve to move to unload said compressor, in response to a requirement to reduce the load on said compressor.

4. The method according to claim 3 further comprising the step of producing a second test control pulse, after a predetermined period, subsequent to said step of producing a test control pulse, if said predetermined conditions continue to indicate the need for said compressor to produce further refrigeration capacity.

5. A method of controlling an operating screw compressor in a refrigeration system, where various system operating parameters affect the amount of current drawn by the drive motor of said operating compressor, comprising the steps of:

controlling the position of the slide valve in said operating screw compressor by causing said slide valve to move a predetermined incremental distance in response to a requirement to load or unload said compressor; and producing a test control pulse under predetermined conditions, which, if the compressor is not operating in an essentially fully loaded condition causes said slide valve to move a distance greater than said incremental distance to further load said compressor.

6. The method according to claim 5 further , comprising the step of monitoring the current drawn by the drive motor of said operating compressor.

7. The method according to claim 6 wherein if said operating compressor is not operating in an essentially fully loaded condition, the production of a test control pulse causes said slide valve to move to further load said compressor to a degree which is readily monitorable, in said monitoring step, as an increase in the current drawn by said compressor drive motor which is directly attributable to the production of said test control pulse and the movement of said slide valve which results therefrom.

8. The method according to claim 6 wherein if said operating compressor is in an essentially fully loaded condition, subsequent to the sending of a test control pulse, said test control pulse is ineffective to cause said slide valve to move to further load said compressor to a degree which will result in an increase in the current drawn by said drive motor which exceeds a predetermined level of increase.

9. The method according to claim 8 further comprising the step of energizing an additional screw compressor in said refrigeration system, if one is available to be energized, if subsequent to the sending of a test control pulse the increase, if any, in the amount of current drawn by the drive motor of said operating compressor fails to exceed said predetermined level of increase.

10. A method of staging compressors in a water amount of current drawn by the drive motor of a system compressor can be affected by a plurality of system operating parameters, comprising the steps of:

controlling the position of the slide valve of a first of said screw compressors in said chiller by, at predetermined intervals, producing a normal control pulse in response to a requirement to further load or unload said first compressor, a normal control pulse being a pulse which causes the slide valve of said first compressor to move a predetermined incremental distance, monitoring the current drawn by the drive motor of said first compressor; and producing, under predetermined conditions, a test load control pulse having a duration greater than the duration of a normal control pulse so that (i) if said first compressor is not operating in an essentially fully loaded condition, said slide valve is caused to be moved to further load said first compressor to a degree which is readily monitorable as an increase the current drawn by the drive motor of said first compressor and which is directly attributable to the production of said test pulse, and, so that (ii) if said compressor is operating in an essentially fully loaded loading of said compressor to a degree which is monitorable as an increase in the current drawn by the drive motor of said first compressor which is attributable to the production of, said test pulse.

11. The method according to claim 10 further comprising the step of energizing an additional compressor if the monitored drive motor current of said first compressor fails to increase to a degree which is attributable to the production of a test pulse subsequent to a test pulse being produced.

12. The method according to claim 11 wherein said chiller system includes an evaporator and wherein said method further comprises the step of monitoring the temperature of chilled water leaving said evaporator.

13. The method according to claim 12 wherein the monitored leaving water temperature must exceed a predetermined temperature prior to the occurrence of said step of producing a test load control pulse.

14. The method according to claim 13 further comprising the step of commencing to integrate a time versus leaving water temperature curve with respect to said predetermined temperature as soon as said leaving water temperature exceeds said predetermined temperature.

15. The method according to claim 14 further comprising the step of inhibiting the production of a test load control pulse until such time as the integration of said curve in said commencing step yields a value which exceeds a first predetermined limit.

16. The method according to claim 15 further comprising the step of continuing to integrate said curve subsequent to the production of a test load control pulse.

17. The method according to claim 16 further comprising the step of immediately proceeding to energize an additional compressor, if one is available, subsequent to said continuing step, as soon as said continued integration of said curve yields a value which exceeds a second predetermined limit, irrespective of whether a test load control pulse has been produced.

18. A water chiller comprising:

a first motor-driven screw compressor;

a second motor-driven screw compressor;

a water cooled evaporator; and means for controlling the operation of said first and second motor-driven screw compressors in accordance with the temperature of water leaving said evaporator, said means for controlling said first and second compressors (i) positioning the slide valve of said first compressor by, at predetermined intervals, producing a normal slide valve control signal in response to a requirement to load or unload said first compressor and said (ii) monitoring the current drawn by the motor of said first compressor and (iii) producing, under predetermined conditions, a test slide valve control signal fully loaded condition, results in the further loading of said first compressor to a degree which is readily monitorable as an increase of a predetermined amount in the current drawn by the drive motor of said first compressor, said means for controlling said first and second compressors energizing said second compressor if the current drawn by the motor of said first compressor fails to increase said predetermined amount in response to the production of a test pulse.

19. The water chiller according to claim 18 further comprising an air-cooled condenser.

20. The water chiller according to claim 19 wherein said first and said second screw compressors are components of discrete refrigeration circuits within said water chiller.

* * * * *

UNITED STATES PATENT AND TRADEMARK OFFICE

CERTIFICATE OF CORRECTION

PATENT NO. : 5,027,608

DATED : July 2, 1991

INVENTOR(S) : Paul C. Rentmeester, Michael W. Murry, Robert E. Krocker and Thomas J. Clanin It is certified that error appears in the above-identified patent and that said Letters Patent is hereby corrected as shown below:

Column 1, line 29, after the word "rotors" insert --.--.

Column 2, line 3, after the words "that is" insert --,--.

Column 2, line 62, after the word "valves" insert --,--.

Column 7, line 60, after the word "Y" insert --.--.

In The Claims:

Claim 1, Column 1, line 34, after the word "the" delete [:;].

Claim 1, Column 1, line 37, after the word "with" insert --the load on said compressor; and--.

Claim 10, Column 14, line 48, after the word "water" insert --chiller system employing multiple screw compressors, where the--.

Claim 10, Column 15, line 5, after the word "loaded" insert --condition, said test pulse will fail to cause the further--.

Claim 18, Column 16, line 23, after the word "signal" insert --which, if said compressor is not operating in an essentially--.

Signed and Sealed this

First Day of December, 1992

*Attest:*

DOUGLAS B. COMER

*Attesting Officer*

*Acting Commissioner of Patents and Trademarks*